FIP8011 OR 4,042,025

United States Patent [19]

Skinner et al.

[11] 4,042,025

[45] Aug. 16, 1977

[54] HYDRAULIC CONTROL SYSTEM UNDERFLOW VALVE CONTROL METHOD AND APPARATUS

[75] Inventors: David R. Skinner, Odessa; Miles L. Sowell; Marvin W. Justus, both of Levelland, all of Tex.

[73] Assignee: Standard Oil Company (Indiana), Chicago, Ill.

[21] Appl. No.: 724,060

[22] Filed: Sept. 17, 1976

[51] Int. Cl.[2] ..... E21B 43/00

[52] U.S. Cl. ..... 166/250; 166/53; 166/68; 166/75 R

[58] Field of Search ..... 166/250, 314, 53, 67, 166/68, 68.5, 75, 105, 105.5; 417/390, 278, 279, 77; 233/47 R

[56] References Cited

U.S. PATENT DOCUMENTS

| | | | |
|---|---|---|---|
| 2,046,769 | 7/1936 | Coberly | 166/68.5 X |
| 2,119,737 | 6/1938 | Coberly | 166/68.5 X |
| 2,593,729 | 4/1952 | Coberly | 417/390 |
| 3,614,761 | 10/1971 | Rehm et al. | 166/250 X |
| 3,705,626 | 12/1972 | Glenn, Jr. et al. | 166/250 X |
| 3,709,292 | 1/1973 | Palmour | 166/68 |
| 3,759,324 | 9/1973 | Mecusker | 166/75 |
| 3,782,463 | 1/1974 | Palmour | 166/68 |
| 3,802,501 | 4/1974 | Mecusker | 166/75 |
| 3,982,589 | 9/1976 | Wilson et al. | 166/53 |

*Primary Examiner*—Stephen J. Novosad
*Attorney, Agent, or Firm*—R. A. Stoltz

[57] ABSTRACT

This is a method and apparatus for a control system for a well-fluid hydraulic pumping unit. The system senses level in the suction vessel and operates an underflow throttling valve to control both the level in the suction vessel and the flows of the cyclone separator. The system maintains the level in the horizontal suction vessel and simultaneously maintains flows to the cyclone in a range for effective cleaning of the fluid and for self-cleaning of the underflow. The cyclone and its associated hardware are sized based on the above-ground pump flow and any bleed flow from the suction vessel. The system is generally applicable to hydraulic units in which the speed of the above-ground pump is not varied over a wide range.

8 Claims, 4 Drawing Figures

HYDRAULIC CONTROL SYSTEM UNDERFLOW VALVE CONTROL METHOD AND APPARATUS

CROSS-REFERENCE TO RELATED APPLICATION

In concurrently filed application Ser. No. 724,037 entitled "Downhole Pump Speed Control," filed Sept. 17, 1976 by Skinner, Sowell, and Justus, is described a control system for a hydraulic pumping unit which uses two fluid-flow metering means and controls the flow rate to the downhole pump to cause the power fluid-flow rate to be maintained essentially directly proportional to the return flow from the well. In this co-pending application, the power fluid flow is not varied to maintain any of the fluid flows constant, but, conversely, changes the power fluid flow in the same manner in which the return fluid flow changed.

BACKGROUND OF THE INVENTION

This invention relates to hydraulic pumping systems for pumping hydrocarbon fluids, and, more particularly, to control of the flows through the cyclone separator and of the level of the fluid in the horizontal suction vessel.

Hydraulically actuated downhole pumps have been used rather than beam-pumping units in many locations. Hydraulic pumping units are especially attractive in deeper and higher producing wells, but the downhole pumps for such systems have required frequent maintenance.

A hydraulic pumping system uses an above-ground pump (typically, a triplex pump) to supply pressurized fluid, some of which is used to actuate the downhole, hydraulically actuated pump. The downhole pump generally returns at least some of the power fluid, together with produced well fluids. A portion of the return fluid is then conditioned by a cyclone separator for use as power fluid. In the past, there has apparently been no automatic throttling on the underflow of the cyclone separator (however, valves, which close automatically when the power is off, have been used) and the level in the suction vessel has been controlled by sensing the level and, in effect, dumping fluid to the flowline when the level reaches some predetermined point.

Hydraulic pumping systems are described in, for example, U.S. Pat. Nos. 2,046,769, 2,119, 737, and 2,593,729, issued to Coberly; and U.S. Pat. Nos. 3,709,292 and 3,782,463, issued to Palmour.

SUMMARY OF THE INVENTION

It has been discovered that the very short operating time between repairs (typically, only approximately one month), which is commonly being experienced, is due in large part to improper operating conditions of the cyclone separator. This invention provides for sizing of the cyclone separator and controlling its operating conditions to avoid transients and clogging of the cyclone underflow which interfere with proper cleaning of the fluid. The use of this system has resulted in a several-fold increase in the operating time between repairs of the downhole pump.

This control system is for a well-fluid hydraulic pumping unit of that type wherein an above-ground pump supplies a flow of pressurized fluid, at least some of which is used as power fluid for a downhole hydraulically actuated pump. The downhole pump returns fluid which is at least some of the power fluid together with the produced well fluid to the surface. A portion of the return fluid is conditioned and sent to a suction vessel for use as power fluid. The remainder of the return fluid is sent to the flowline as output of the well.

This controller self-cleans the cyclone underflow and maintains a cyclone flow within the range in which a cyclone cleans effectively. It also controls the level in the suction vessel. The system includes a cyclone separator having an inlet connected (directly or indirectly) to the well, an overflow outlet connected to the suction vessel, and an underflow outlet connected to a underflow throttling valve which leads to the flowline. The cyclone is sized to have an inlet flow of about 1.05–1.5 times the inlet flow of the power-fluid pump (or about 1.05–1.25 times the inlet flow of the power-fluid pump plus any bleed flow from the suction vessel). A level-sensing means is used to produce a signal indicative of the liquid level in the suction vessel, and this signal is connected to the controller means which generates an output signal to the underflow valve positioner to adjust the position of the underflow valve to maintain the liquid level in the suction vessel essentially constant.

BRIEF DESCRIPTION OF THE DRAWINGS

A better understanding of the invention may be obtained by reference to the accompanying drawings, in which.

DESCRIPTION OF THE PREFERRED EMBODIMENTS

Figure 1:
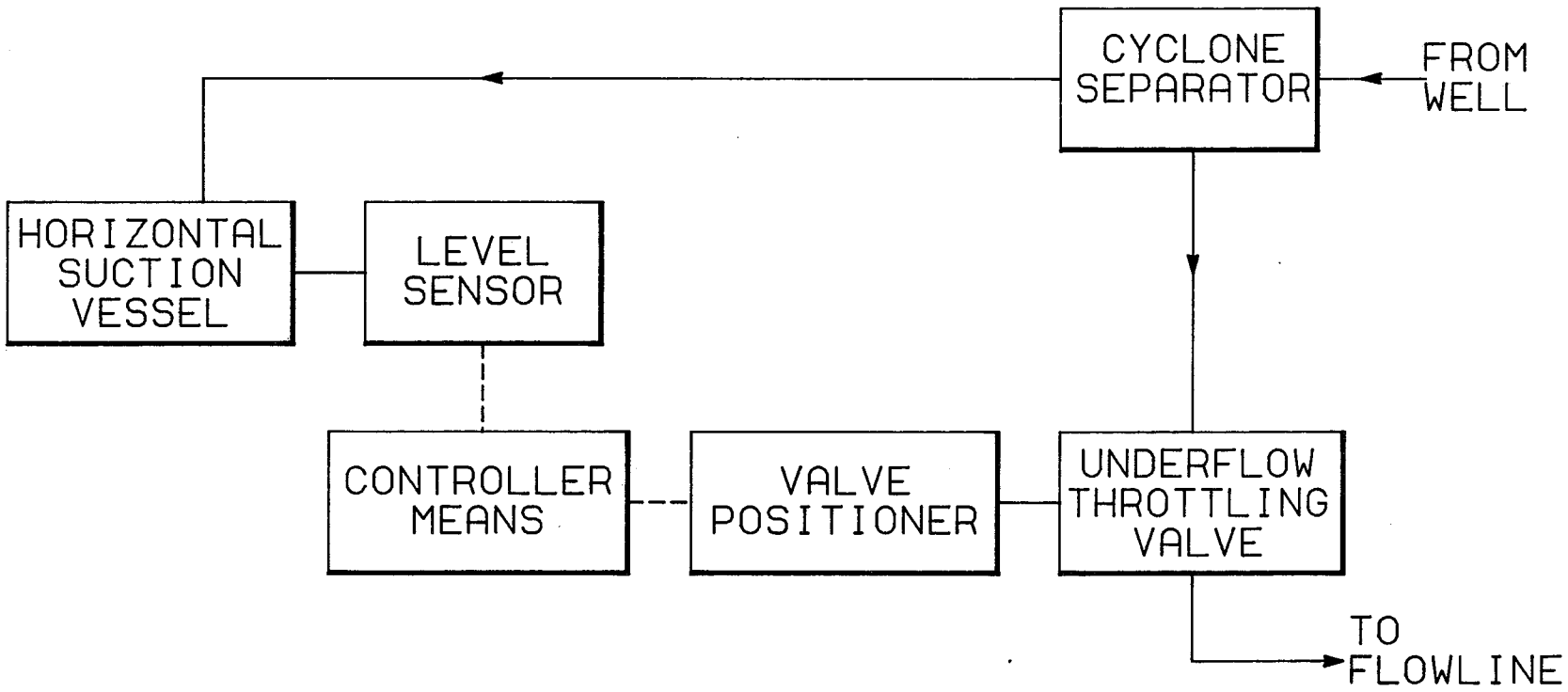
FIG. 1 is a block diagram showing the relationship of the basic elements of the control system.

FIG. 1 shows the basic relationship of the elements of the invention. Fluid from the well flows into the cyclone separator. This fluid may come directly, or may come through other equipment, such as a vertical separator vessel before entering the cyclone separator. Cleaned fluid is passed through the cyclone overflow to the horizontal suction vessel, while most of the solids (and some liquid) flow out the cyclone underflow through the underflow throttling valve and to the flowline. It is important that some fluid flow is maintained through the underflow to prevent clogging and the cyclone is sized for a inlet flow of at least 1.05 times the inlet flow of the power-fluid pump (plus any bleed flow from the suction vessel).

The flow out the overflow of the cyclone separator is, on the average, equal the flow into the above-ground pump plus any bleed flow from the horizontal suction vessel. This control system is for hydraulic pumping units in which the above-ground pump is driven by an substantially constant speed prime mover (i.e., an AC electric motor supplied for GO Hertz power), and therefore the flow through the above-ground pump is subject only to relatively small variations. Any bleed flow from the suction vessel is to be either essentially constant or relatively small (or both). Thus, on the average, the flow through the cyclone separator can be maintained nearly constant. As cyclones have generally been found not to separate well when the underflow exceeds 25 percent of the overflow, the cyclone should be sized to have an inlet flow of about 1.05–1.25 times the inlet flow of the power-fluid pump plus any bleed flow from the suction vessel. The cyclone separator should be run with between 30–50 psi across the cyclone (perferably about 40). The cyclone hardware (feed nozzle, vortex, type and size, and liner), therefore, should be sized based on the power-fluid pump flow (plus the horizontal suction vessel bleed flow, if any). Tables 1 and 2 below contain cyclone hardware sizing information for typical inlet flow rates in barrels per day (BPD). The pressure drops are in psi and the feed nozzle and ID dimensions are in inches. Table 1 is for a 3-inch Pioneer cyclone with a 0.65-inch apex. Table 2 is for a 4-inch Pioneer cyclone with a 0.688-inch apex.

TABLE 1

| FEED NOZZLE | VORTEX TYPE/ID | PRESSURE DROP | INLET RATE |
|---|---|---|---|
| .500 | Standard/.75 | 30 | 612 |
| | | 40 | 741 |
| | | 50 | 782 |
| .500 | Spiral/.75 | 30 | 680 |
| | | 40 | 816 |
| | | 50 | 884 |
| .500 | Spiral/1.00 | 30 | 816 |
| | | 40 | 918 |
| | | 50 | 936 |
| .500 | Spiral/1.25 | 30 | 850 |
| | | 40 | 838 |
| | | 50 | 1,122 |
| .600 | Standard/.75 | 30 | 782 |
| | | 40 | 884 |
| | | 50 | 952 |
| .600 | Spiral/.75 | 30 | 850 |
| | | 40 | 952 |
| | | 50 | 1,088 |
| .600 | Spiral/1.00 | 30 | 1,020 |
| | | 40 | 1,190 |
| | | 50 | 1,292 |
| .600 | Spiral/1.25 | 30 | 1,156 |
| | | 40 | 1,360 |
| | | 50 | 1,496 |

TABLE 2

| FEED NOZZLE | VORTEX TYPE/ID | PRESSURE DROP | INLET RATE |
|---|---|---|---|
| .500 | Standard/1.50 | 20 | 857 |
| | | 30 | 1,074 |
| | | 40 | 1,226 |
| .600 | Standard/1.5 | 20 | 1,131 |
| | | 30 | 1,334 |
| | | 40 | 1,532 |
| .700 | Standard/1.50 | 20 | 1,227 |
| | | 30 | 1,467 |
| | | 40 | 1,651 |
| .800 | Standard/1.50 | 20 | 1,255 |
| | | 30 | 1,499 |
| | | 40 | 1,717 |
| .500 | Spiral/1.50 | 20 | 924 |
| | | 30 | 1,234 |
| | | 40 | 1,389 |
| .600 | Spiral/1.50 | 20 | 1,260 |
| | | 30 | 1,608 |
| | | 40 | 1,776 |
| .700 | Spiral/1.50 | 20 | 1,430 |
| | | 30 | 1,783 |
| | | 40 | 1,975 |
| .800 | Spiral/1.50 | 20 | 1,474 |
| | | 30 | 1,819 |
| | | 40 | 2,039 |

In addition to sizing the cyclone separator appropriately for its average inlet flow, it is also necessary to avoid transients which take the cyclone outside of its proper operating conditions. It has been found that a major source of harmful transients in the past has been the operation of the level-control system in the suction vessel. In the past, the valve from the horizontal suction vessel has opened completely when activated and then closed completely, rather than throttling.

Thus, two difficulties with the cyclone system operation remain even with a properly sized cyclone. The first difficulty is due to the above mentioned transients caused by the dumping action of the valve in the horizontal suction vessel. The second difficulty is the clogging of the underfow line from the cyclone. It has been found that both of these difficulties can be circumvented by placing a throttling valve in the underflow line of the cyclone separator and automatically controlling this throttling valve based on the level in the horizontal suction vessel. The throttling action avoids the flow transients. The clogging of the underflow valve is avoided because when the underflow line starts to clog, the flow into (and thus level in) the suction vessel will increase. This control system will then open the underflow throttling valve which will increase the fluid flow and generally eliminate the clog.

Thus, it may be seen that the control system simultaneously maintains the level in the suction vessel, avoids transients in the cyclone, and automatically clears partial clogging of the underflow line.

Figure 2:
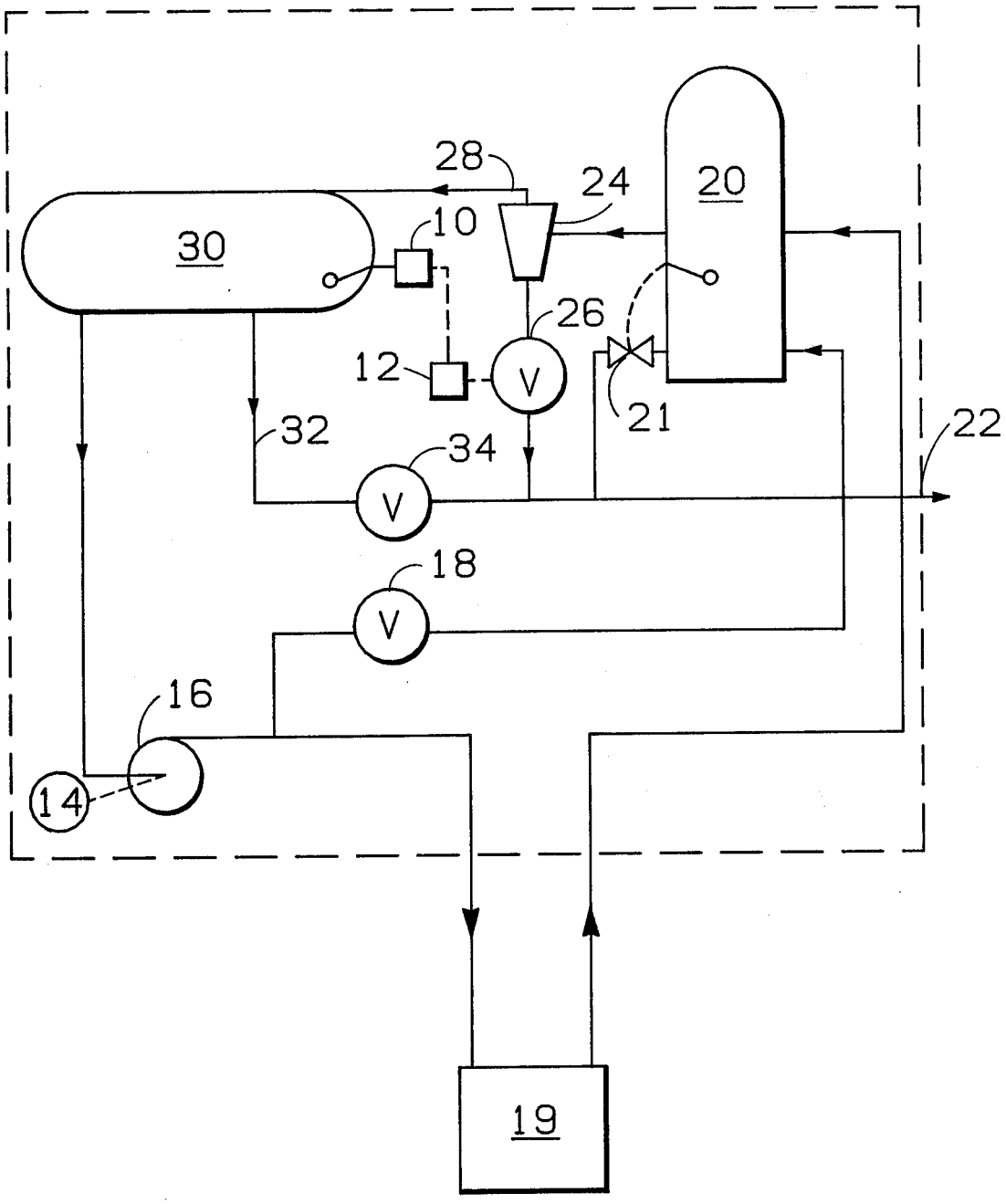
FIG. 2 shows an underflow throttling valve on a schematic of a hydraulic pumping system.

FIG. 2 shows a schematic of a hydraulic pumping unit. A suction vessel level sensor 10 is used to control the underflow valve positioner 12.

An electric motor 14 drives the triplex above-ground pump 16 and a portion of its output fluid (that which is not bypassed through bypass valve 18) actuates the downhole pump 19. The downhole pump 19 return fluid flows to the vertical separator 20. Fluid which flows through the bypass valve 18 also flows ito the vertical separator 20. Typically, some of the fluid from the vertical separator 20 goes through valve 21 to the flowline 22 and care should be taken such that this flow is smoothly throttled, rather than overcontrolled and abruptly dumped, as dumping from the vertical separator 20 through valve 21 also adversely affects cyclone operation. Signal blocking circuits (as taught herein) can be used to prevent a dumping action through overcontrol of valve 21. Fluid which does not flow to the flowline 22 goes to the cyclone separator 24. A portion of the cyclone separator flow with most of the solids entrained goes out through underflow valve 26 to the flowline 22. Clean (conditioned) fluid comes out the cyclone separator overflow 28 and flows to the horizontal suction vessel 30. This conditioned fluid is then available to be pumped to the downhole pump 19 by the triplex pump 16.

In some well conditions, it is desirable to have a bleedline 32 from the horizontal suction vessel 30 to the flowline 22 to prevent buildup of fluid in the suction vessel 30 of the type of fluid which is not being used as power fluid. Typically, oil is used as the power fluid and the bleedline 32 may be used to eliminate water buildup in the suction vessel 30. Preferably, the flow through the bleedline 32 should be relatively low (i.e., less than 25 percent of the inlet flow of the power-fluid pump 16). The flow through the bleedline 32 could be throttled by a valve 34 operated by the same controller, in which case, operation of valve 34 in the bleedline 32 is to be smoothly throttled, and dumping is to be avoided.

Figure 3:
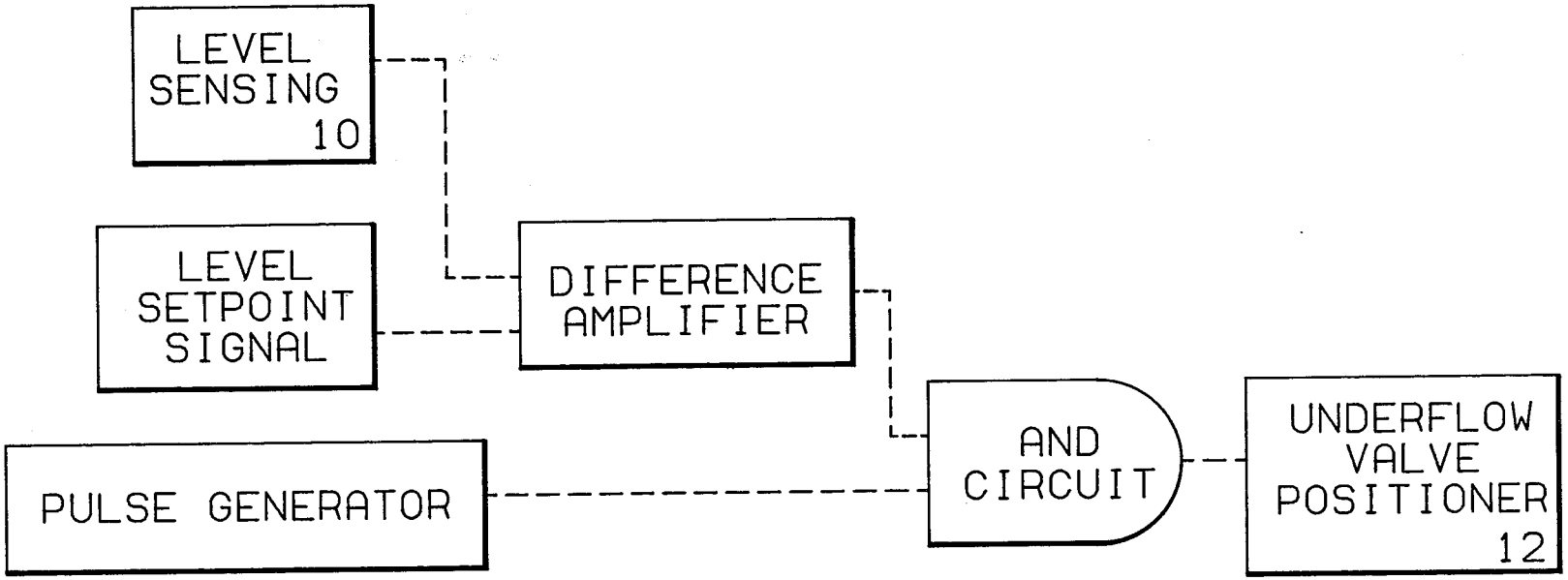
FIG. 3 is a block diagram showing an embodiment including circuitry to prevent overcontrolling of the underflow valve.

FIG. 3 shows a block diagram of elements of a primarily electronic control system. A level sensor 10 sends a signal to one of the inputs of a difference amplifier. The other input of the difference amplifier is connected to a predetermined set-point signal, and the difference amplifier together with the set-point signal act as a controller means which generates an output to be sent to the underflow valve positioner 12. Here, an AND circuit and a generator act as a signal-blocking circuit to allow only periodic adjustment of the underflow valve and thereby avoid overcontrolling of the underflow valve.

Figure 4:
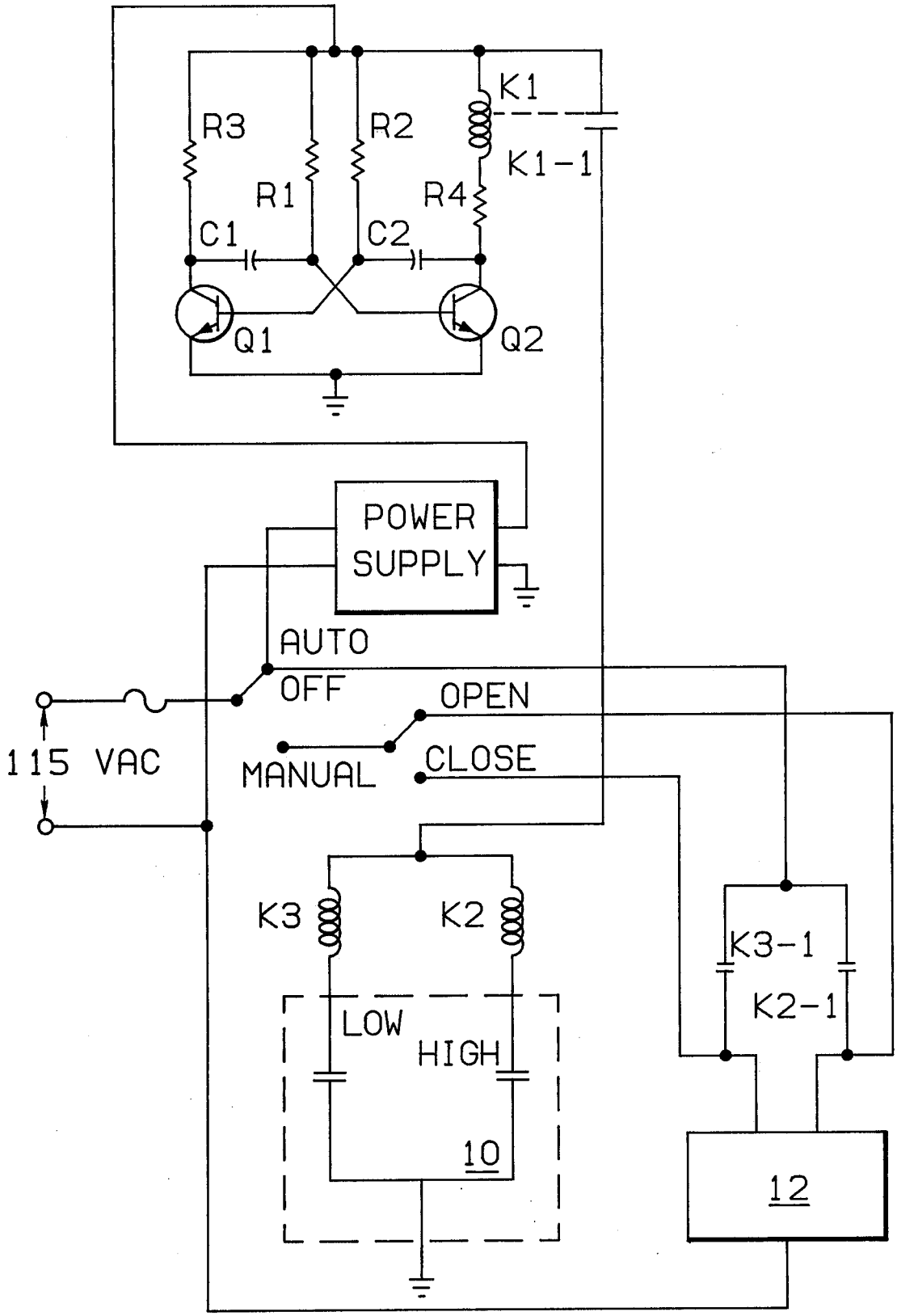
FIG. 4 is a circuit diagram of a particular embodiment.

FIG. 4 shows an embodiment which is primarily electromechanical. Table 3 gives typical component values for the electronic components in FIG. 4.

TABLE 3

| | VALUE |
|---|---|
| R1 | 2K |
| R2 | 470K |
| R3 | 1.2K |
| R4 | 270 ohms |
| R5 | 10K |
| C1 | 250 mfd |
| C2 | 50 mfd |
| Q1, Q2 | 2N4141 |

Generally, if the level in the suction vessel rises, the high set-point contacts of sensing means 10 will close and when contacts K1-1 of relay K1 are closed, relay K2 will be energized. Contact K2-1 of relay K2 will then be closed and the underflow valve 26 will be driven for a short period of time in the open direction.

As shown, relay K1 will alternately be energized for approximately 100 milliseconds and then be de-energized for approximately 2 minutes. The energized time is determined by R1 C2, and the de-energized time is determined by R2 C1.

If the level in the horizontal suction vessel gets too low, the low set-point on the sensing means 10 will close, relay K3 will be energized during the time period in which contact K1-1 is closed, and during this time contact K3-1 will close to drive the underflow valve 26 in the closed direction. Closing the underflow valve 26 slightly will decrease the flow out the underflow and increase the flow out the cyclone overflow 28. Increasing the flow out the overflow 28 will cause the level in the horizontal suction vessel 30 to rise back toward the desired level.

There are, of course, many alternate ways of controlling the position of the underflow valve 26 based on the level in the horizontal suction vessel 30. A gear reduction (1000 to 1, for example) could be used between the valve actuator 12 and the underflow valve 26 to slowdown the movement of the underflow valve 26 as an alternate method to prevent overcontrolling in place of the electronic system shown in FIG. 4 (generally K1, Q1, Q2, R1-R4, C1, and C2). Similarly, other types of systems, such as all pneumatic, could be used rather than the electronic and electromechanical system shown in FIG. 4.

The invention is not construed as limited to the particular embodiments described herein, since these are to be regarded as illustrative rather than restrictive. The invention is intended to cover all configurations which do not depart from the spirit and scope of the invention.

We Claim:

1. A control system for a well-fluid hydraulic pumping unit of the type wherein an above-ground pump, driven by a substantially constant-speed prime mover, supplies a flow of pressurized fluid, at least some of which is used as power fluid to a downhole hydraulically actuated pump, which downhole pump returns fluid which is at least some of the power fluid together with produced well fluids to the surface, a portion of which return fluid is conditioned and sent to a suction vessel for use as power fluid and wherein the remainder of the return fluid is sent to a flowline as output of the well, said control system comprising:

a. a cyclone separator having an inlet connected to the well, and overflow outlet connected to the suction vessel, and an underflow outlet, said cyclone being sized to have an inlet flow of about 1.05–1.5 times the inlet flow of the power-fluid pump;

b. an underflow throttling valve connected between said cyclone underflow outlet and the flowline;

c. an underflow valve positioner connected to control the position of said underflow valve;

d. level-sensing means to produce a signal indicative of the liquid level in the suction vessel; and e. controller means connected to receive the level-sensing means signal and having an output connected to said underflow valve positioner, said controller means generating an output signal to adjust the position of the underflow valve to maintain the liquid level in the suction vessel essentially constant.

2. The system of claim 1, wherein a bleedline is connected between said horizontal suction vessel and said flowline.

3. The system of claim 2, wherein a bleed valve is connected in said bleedline and is throttled by said controller means.

4. The controller of claim 1, wherein a signal-blocking circuit is connected between said controller means output and said underflow valve positioner, said signal-blocking circuit allowing only periodic adjustment of said underflow throttling valve.

5. The system of claim 1, wherein the cyclone is sized to have an inlet flow of about 1.05–1.25 times the inlet flow of the power-fluid pump.

6. The control system of claim 1, wherein a bleedline is connected between said suction vessel and said flowline, and said cyclone is sized to have an inlet flow of about the flow in said bleedline plus 1.05–1.25 times the inlet flow of the power-fluid pump.

7. A method for controlling a well-fluid hydraulic pumping unit of the type wherein an above-ground pump is driven by a substantially constant-speed prime mover and takes fluid from a suction vessel and supplies a flow of pressurized fluid, at least some of which is used as power fluid to a downhole hydraulically actuated pump, which downhole pump returns fluid, which is at least some of the power fluid together with produced well fluids to the surface, a portion of which return fluid is conditioned and sent to the suction vessel and wherein the remainder of the return fluid is sent to a flowline as output of the well, and wherein a bleed flow is taken from the suction vessel to the flowline said method comprising:

a. sizing a cyclone separator to have a inlet flow of about 1.05–1.25 times the inlet flow of the power-fluid pump plus the bleed flow from the suction vessel;

b. sensing the liquid level in the suction vessel;

c. a valve between said cyclone underflow outlet and the flowline; and d. adjusting the throttling of said underflow valve as a function of the level in said suction vessel to maintain the level in said suction vessel, whereby the level in the suction vessel, proper flow to the cyclone, and an unplugged underflow from said cyclone are simultaneously maintained.

8. The method of claim 7, wherein the bleedline is sized to have a flow of between 0 and 0.25 times the inlet flow of the power-fluid pump.

* * * * *

UNITED STATES PATENT OFFICE
CERTIFICATE OF CORRECTION

PATENT NO. : 4,042,025

DATED : August 16, 1977

INVENTOR(S) : David R. Skinner, Miles L. Sowell and Marvin W. Justus

It is certified that error appears in the above-identified patent and that said Letters Patent are hereby corrected as shown below:

Column 2, line 61, after "for", "GO" should read -- 60 --.

Column 4, line 8, "underfow" should be -- underflow --;
line 32, "ito" should be -- into --.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*